US008905725B2

(12) United States Patent
Roberts

(10) Patent No.: US 8,905,725 B2
(45) Date of Patent: Dec. 9, 2014

(54) WATER-POWERED PUMP ACTUATION SYSTEM

(75) Inventor: Denis Francis Roberts, Hays, KS (US)

(73) Assignee: Denis Francis Roberts, Hays, KS (US)

( * ) Notice: Subject to any disclaimer, the term of this patent is extended or adjusted under 35 U.S.C. 154(b) by 328 days.

(21) Appl. No.: 13/366,535

(22) Filed: Feb. 6, 2012

(65) Prior Publication Data

US 2013/0202459 A1 Aug. 8, 2013

(51) Int. Cl.
*F04B 9/06* (2006.01)

(52) U.S. Cl.
USPC ..... 417/329

(58) Field of Classification Search
CPC ..... F04B 47/04; F04B 47/14; F04B 47/145; F04B 47/022
USPC ..... 417/329, 328; 60/640
See application file for complete search history.

(56) References Cited

U.S. PATENT DOCUMENTS

| | | | | |
|---|---|---|---|---|
| 3,793,904 | A * | 2/1974 | Grable | 74/590 |
| 3,807,902 | A * | 4/1974 | Grable et al. | 417/46 |
| 4,209,990 | A * | 7/1980 | Shelton, Jr. | 60/640 |
| 4,286,928 | A * | 9/1981 | Clay | 417/329 |
| 4,306,463 | A * | 12/1981 | King | 74/99 R |
| 2012/0017589 | A1 * | 1/2012 | Ackman | 60/640 |

* cited by examiner

*Primary Examiner* — Devon Kramer
*Assistant Examiner* — Charles W Nichols
(74) *Attorney, Agent, or Firm* — Hovey Williams LLP

(57) ABSTRACT

A water powered pump actuation system configured to power a reciprocating element of a pump. The pump actuation system may comprise a base, a wheel rotatably attached to the base, an attachment element fixed to the wheel and configured to fix the reciprocating element to the wheel. Rotation of the wheel in a first direction raises the reciprocating element and rotation of the wheel in a second direction lowers the reciprocating element. The actuation system may also comprise a cable attached to the wheel and a container attached to the cable, such that rotation of the wheel in the first direction lowers the container and rotation of the wheel in the second direction raises the container. Wheel rotation is controlled by water being cyclically pumped into and then emptied from the container via a pump in a reservoir below the container.

5 Claims, 4 Drawing Sheets

WATER-POWERED PUMP ACTUATION SYSTEM

BACKGROUND

Oil pumping systems, such as sucker rod pump systems and other such systems used by small oil companies, use a great deal of electricity. In a traditional pump jack system, a sucker rod is pumped up and down in an oil well to pump oil deep in the ground up to the surface. The sucker rod pump may use a motorized teeter-totter-like device to raise and lower the pump and may require a motor with enough horsepower to lift a 25-ft sucker rod weighing thousands of pounds. Powering such motors can cost the owner millions of dollars in electricity costs. Furthermore, the heavy motorized teeter-totter-like device is difficult to move to different locations.

SUMMARY

The present invention solves the above described problems by providing a pump actuation system powered with fluid pumps, such as sump pumps. The pump actuation system may be configured for actuating a reciprocating element of a fluid pumping device and may comprise a base, a primary actuation element configured to pivot or rotate relative to the base an attachment element configured to fix the primary actuation element to the reciprocating element, and a container attached to the primary actuation element. The container may comprise at least one outlet hole formed therethrough and one inlet hole formed therethrough. The pump actuation system may also comprise a flapper configured for covering the outlet hole in a first position and uncovering the outlet hole in the second position such that liquid may exit through the outlet hole. Furthermore, the pump actuation system may comprise a reservoir located beneath the container outlet hole, at least one pump located in the reservoir, and a hose fluidly connecting the pump with the inlet hole of the container. The primary actuation element may be configured to pivot or rotate in a first direction, simultaneously lowering the container and raising the reciprocating element, when a threshold amount of liquid is in the container and to pivot or rotate in a second direction, simultaneously raising the container and lowering the reciprocating element, when liquid is emptied from the container through the outlet hole.

In another embodiment of the invention, the actuation system for actuating a reciprocating element of a fluid pumping device may comprise a base, a wheel rotatably attached to the base, and an attachment element fixed to the wheel and configured to fix the reciprocating element to the wheel, such that rotation of the wheel in a first direction raises the reciprocating element and rotation of the wheel in a second direction lowers the reciprocating element. The actuation system may also comprise a cable attached to the wheel and configured to be wound on and unwound from the wheel as the wheel rotates and a container attached to the cable, such that rotation of the wheel in the first direction lowers the container and rotation of the wheel in the second direction raises the container. The container may comprise at least one outlet hole formed therethrough and one inlet hole formed therethrough. The pump actuation system may also comprise a flapper configured for covering the outlet hole in a first position and uncovering the outlet hole in the second position such that liquid may exit through the outlet hole. Furthermore, the pump actuation system may comprise a reservoir configured to hold liquid and located beneath the container outlet hole, at least one pump located in the reservoir, and a hose fluidly connecting the pump with the inlet hole of the container.

Another embodiment of the invention is a pump actuation system for pumping fluids out from under ground. The pump actuation system may comprise a pump jack comprising a sucker rod configured to reciprocate into and out of an oil well drilled into the ground, a base, a wheel rotatably attached to the base, a horse head fixture fixed to the wheel, and one or more reigns attached to the horse head fixture and attached to the sucker rod. The reigns are attached such that rotation of the wheel in a first direction raises the sucker rod and rotation of the wheel in a second direction lowers the sucker rod. The pump actuation system may further comprise a cable attached to the wheel and configured to be wound on and unwound from the wheel as the wheel rotates and a container attached to the cable such that rotation of the wheel in the first direction lowers the container and rotation of the wheel in the second direction raises the container. The container may comprise at least one outlet hole formed therethrough and one inlet hole formed therethrough. The pump actuating system may also comprise equalizing weights fixed to the cable and weighing less than a weight of the reciprocating element and a flapper configured for covering the outlet hole in a first position and uncovering the outlet hole in the second position such that liquid may exit through the outlet hole. Furthermore, the pump actuation system may comprise a frame fixed relative to the ground and above the container and a flexible line having a first end and a second end. The first end of the flexible line may be attached to the frame and the second end of the flexible line may be attached to the flapper and may limit an amount by which the flapper can be lowered relative to the frame. Specifically, when the container is lowered past a predetermined point, the container may pull away from the flapper, placing the flapper in the second position. Finally, the pump actuation apparatus may comprise a reservoir configured to hold liquid and located beneath the container outlet hole, at least one pump located in the reservoir and configured to pump liquid out of the reservoir, and a hose fluidly connecting the pump with the inlet hole of the container.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

BRIEF DESCRIPTION OF THE DRAWING FIGURES

Embodiments of the present invention are described in detail below with reference to the attached drawing figures, wherein.

Figure 1:
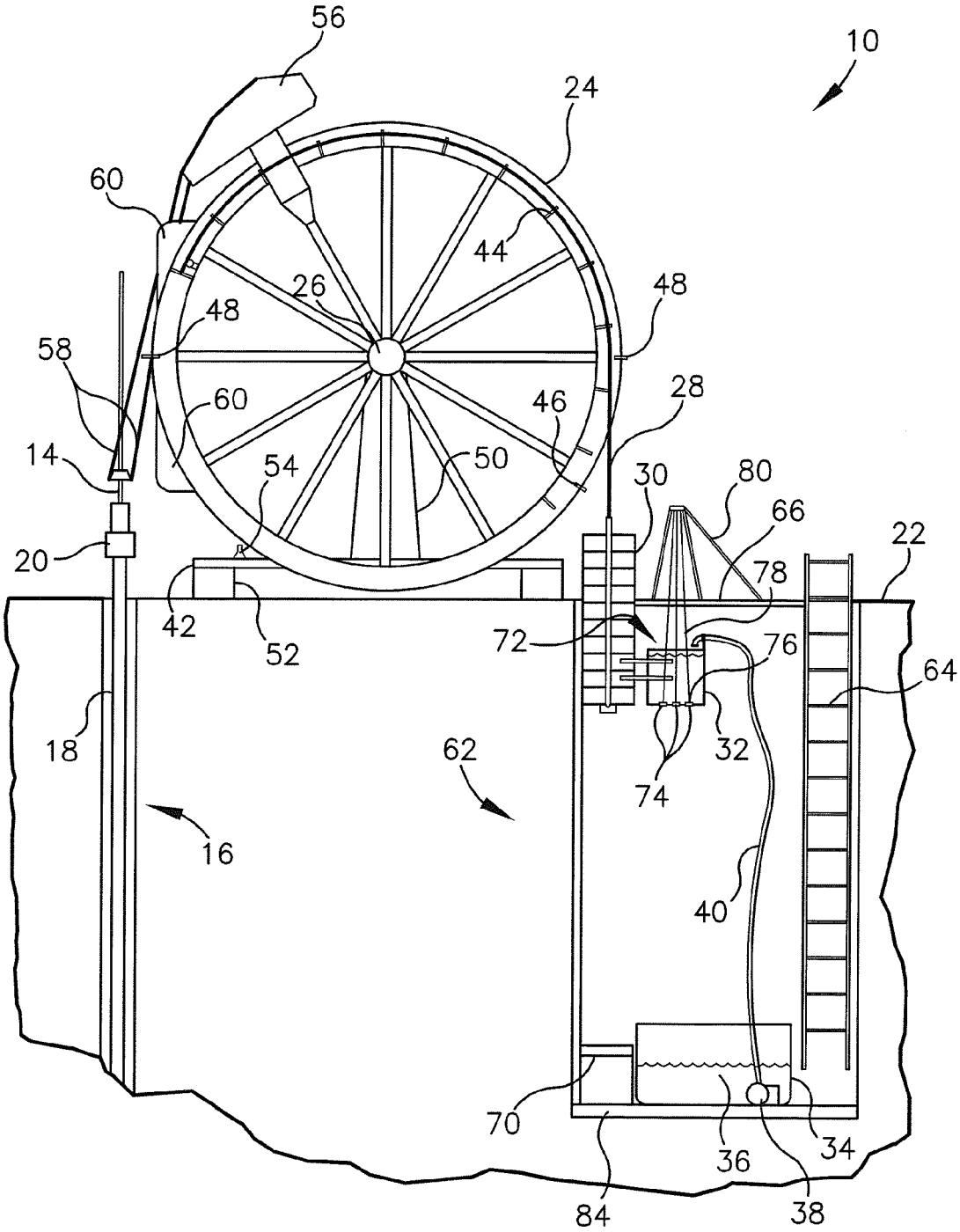
FIG. 1 is a schematic plan view of a pump actuation system constructed in accordance with embodiments of the present invention and oriented in a first orientation.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
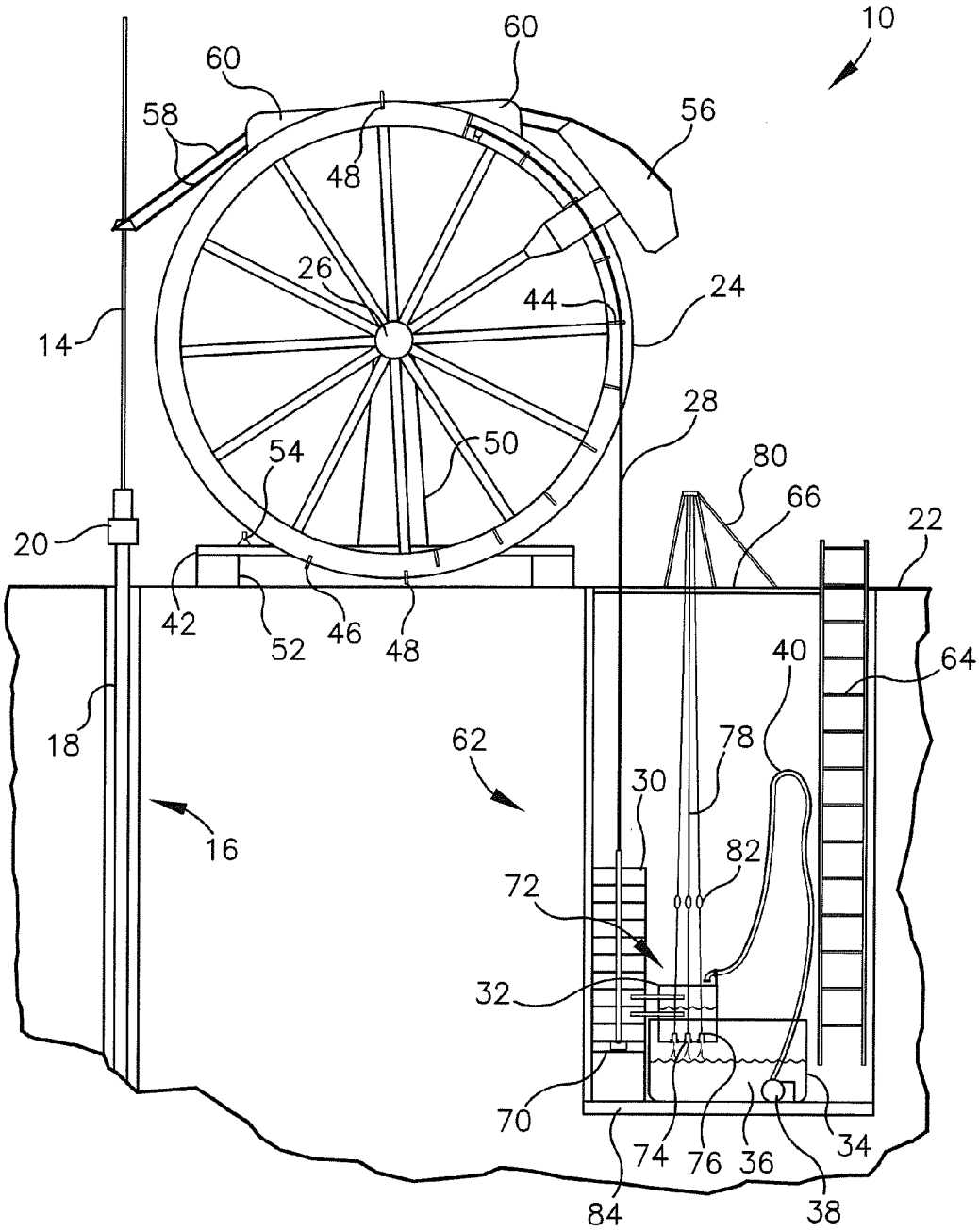
FIG. 2 is a schematic plan view of the pump actuation system of FIG. 1 in a second orientation.
Figure 3:
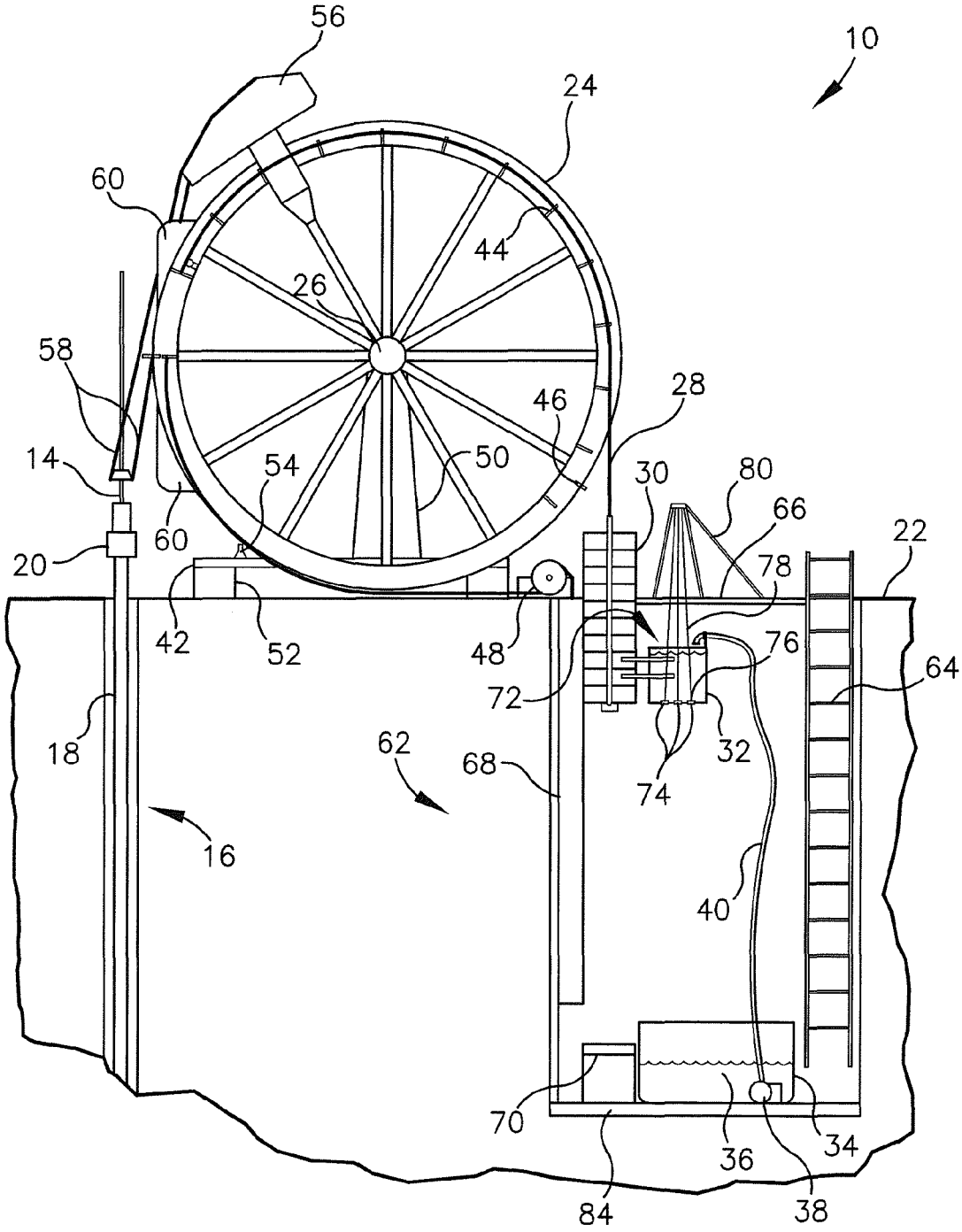
FIG. 3 is a schematic plan view of an alternative embodiment of the pump actuation system of FIG. 1 with a guide channel illustrated therein.

Turning now to the drawing figures, and initially FIGS. 1 and 2, a pump actuation system 10 constructed in accordance with embodiments of the invention is illustrated. The pump actuation system 10 may be configured to power a fluid pumping device 12, such as an oil pump, pump jack, or sucker rod pump. Specifically, the pump actuation system 10 may be configured to actuate a reciprocating element 14, such as a sucker rod which may be lowered and raised into and out of an oil well 16. As depicted in FIGS. 1-3, the oil well 16 may have tubing 18 extending into the oil well 16 through which the reciprocating element 14 slides and a well head 20 at a top of the tubing 18 securing the tubing 18 to ground 22.

The pump actuation system 10 may comprise a wheel 24 rotatable about a shaft 26, at least one cable 28 fixed to the wheel 24, one or more equalizing weights 30 attachable to the cable 28, a container 32 fixed to the cable 28 and/or the equalizing weights 30, a reservoir 34 configured to hold liquid 36 therein, at least one pump 38 configured to pump the liquid 36 out of the reservoir 34, and one or more hoses 40 configured to transport the liquid 36 from the pump 38 to the container 32.

The wheel 24 may be any size in depth and diameter. For example, the wheel 24 may be between 10 feet and 20 feet in diameter with a circumference of between 30 feet and 70 feet. However, any depth, diameter, or circumference may be used without departing from the scope of the invention. Furthermore, the wheel 24 may be mounted at any height above the ground 22 by a base 42 resting on the ground 22 or on a platform surface. In some embodiments of the invention, the wheel 24 may be supported by a plurality of spokes fixed to a ring or cylinder through which the shaft 26 may extend. The shaft 26 inserted through the wheel 24 or the cylinder of the wheel 24 may be fixed to the base 42. Alternatively, the spokes may be fixed to the shaft 26 which may be rotatably supported above the ground by the base 42. In some embodiments of the invention, the shaft 26 may include a gear box and/or other features to assist in rotation of the wheel 24. The wheel 24 may also comprise one or more cable guides 44 configured to prevent the cable 28 from slipping off of the wheel 24. The cable guides 44 may be concave metal ties or other movement-limiting features attached to or integrally formed with the wheel 24. The shape and configuration of the cable guides 44 may also help prevent excessive wear of the cable by the wheel 24.

The wheel 24 may comprise emergency stopping features 46 extending therefrom and configured to limit the amount of rotation of the wheel 24. The emergency stopping features 46 may be a rubber stop, a welded strap, or other protrusions made of any suitable material for limiting rotation of the wheel 24. The wheel 24 may also comprise secondary pulley features 48 extending therefrom. For example, the secondary pulley features 48 may include one or more metal loops extending from the wheel 24 such that a rope or cable may be attached thereto to pull the wheel 24 back into a desired orientation in case the reciprocating element 14 or any elements of the oil well 16 break or malfunction causing the wheel 24 to rotate beyond a desired point under the weight of the equalizing weights 30. As illustrated in FIG. 1, the secondary pulley features 48 may be located on opposite sides of the wheel 24 from each other. In some embodiments of the invention, as illustrated in FIG. 3, the secondary pulley features 48 may comprise a spool rotatable relative to the base 42 and configured to rotatably engage an orientation cable, which may be hooked to one of the metal loops if reorientation of the wheel 24 is needed. Then the spool may be rotated to wind the orientation cable onto the spool, thereby reorienting the wheel 24, or the spool may merely guide the orientation cable as it is pulled by a towing vehicle, such as a truck.

The base 42 may comprise support features 50 extending upward from a pedestal 52 and supporting either end of the shaft 26. The base 42 may further comprise various features or protrusions 54 configured to engage with emergency stopping features 46 extending from the wheel 24. As noted above, the emergency stopping features 24 may be fixed on the wheel 24 at one or more locations to engage with the protrusions 54 of the base if the cable 28 breaks or other various components of the pump actuation system 10 malfunction.

In some embodiments of the invention, the pump actuation system 10 may comprise a horse head fixture 56 or any rigid fixture extending from the wheel 24 with reigns 58 or a secondary cable extending therefrom and configured to attach to the reciprocating element 14, such as the sucker rod of the pump jack. For example, in a first position, the horse head fixture 56 may be fixed about 30-degrees counterclockwise from an axis extending through a center of the wheel 24 and perpendicular to the ground 22. Specifically, the horse head fixture 56 may be tilted toward the reciprocating element 14 in the first position. When the wheel 24 rotates in a clockwise direction from the first position, the horse head fixture 56 may be rotated away from the reciprocating element 14 to a second position. For example, the position of the horse head fixture 56 in the second position may be approximately 90-degrees or less from the position of the horse head fixture 56 in the first position. In some embodiments of the invention, the horse head fixture 56 may be tilted away from the reciprocating element 14 in the second position. Note that the precise location and amount of rotation of the horse head fixture 56 as described herein are merely examples and may be adjusted according to requirements of a particular application.

The pump actuation system 10 may further comprise alignment fixtures 60 configured to keep the reigns 58 properly positioned on the wheel 24. For example, the alignment fixtures 60 may include a top corner piece and/or a bottom corner piece, which may be integrally formed with or attached to the wheel 24 as depicted in FIGS. 1-3. In some embodiments of the invention, there may be two top corner pieces and two bottom corner pieces fixed at front and back sides of the wheel 24, between which the reigns 58 may rest against the wheel 24. Additionally or alternatively, other guide features may protrude from the wheel 24 or from the alignment fixtures 60 to guide the reigns 58 relative to the wheel 24 as the horse head fixture 56 pulls the reigns 58.

The cable 28 may be any sort of flexible cord, rope, or elongated flexible material fixed to the wheel 24 at one end and the equalizing weights 30 at another opposing end. As noted above, the cable 28 may be prevented from slipping off of the wheel 24 by the cable guides 44. The cable 28 may be made of any size, material, and strength sufficient to support the equalizing weights 30. For example, the cable 28 may be a 1-inch cable wire approximately 40 feet long. However, any gage and length of cable may be used, depending on the size of the wheel 24, the distance of the wheel 24 above the ground 22, and the depth at which the reservoir 34 is positioned, as later described herein. In some embodiments of the invention, the cable 28 may be fixed to the wheel 24 at a location proximate to the horse head fixture 56. For example, the cable 28 may be fixed approximately 30-degrees counterclockwise from the horse head fixture 56 and may extend therefrom, in a clockwise direction, past the horse head fixture 56 to the equalizing weights 30. The equalizing weights 30 may hang from the cable 28 adjacent a first side of the wheel 24 and the reciprocating element 14 may be positioned adjacent a second side of the wheel 24 opposite the first side of the wheel 24.

The equalizing weights 30 may be one or more weights permanently attached or detachably attached to the cable 28 and/or attached to the container 32. The total weight of the equalizing weights 30 on the cable 28 may be adjusted depending on the weight of the reciprocating element 14. The purpose of the equalizing weights 30 is to provide a counterbalance to the weight of the reciprocating element 14 positioned on the opposite side of the wheel 24. In some embodiments of the invention, the total weight of the equalizing weights 30 used may be slightly less than the weight of the reciprocating element 14, so that the reciprocating element 14 naturally falls downward, such as through the well head 20 into the oil well 16. Adding additional weight to the cable 28 may pull the reciprocating element 14 back up, for example, out of the oil well 16. In one embodiment of the invention, the reciprocating element 14 may weigh approximately 4,000 lbs, the equalizing weights 30 may total 3,900 lbs, and the container 32 may weigh approximately 50 lbs. The remaining 50 lb deficit may be addressed by filling the container 32 with a liquid such as water. In configurations where one or more of the equalizing weights 30 is detachable from the cable 28, the equalizing weights 30 may have a cavity formed therein sufficient to slide the cable 28 within the cavity. Furthermore, the detachable equalizing weights 30 may comprise a button hook or some other mechanism configured to lock the cable 28 within the cavity of the equalizing weights 30.

In some embodiments of the invention the equalizing weights 30 and the container 32 are separated from the reservoir 34 by the height of the base 42. In other embodiments of the invention, as illustrated in FIGS. 1-3, the equalizing weights 30 and the container 32 are raised and lowered toward and away from the reservoir 34 within a well 62 dug into the ground 22. The reservoir 34 may be positioned at a bottom of the well 34 and a ladder 64 may be positioned therein to allow operators or other individuals access to the reservoir 34 and pumps 38. A grate or another type of safety cover 66 may be placed at a top opening of the well 62 to prevent animals or people from accidentally falling into the well 62. In some embodiments of the invention, the container 32 and/or the equalizing weights 30 may be limited to only vertical movement within the well 62 by a guide channel 68 placed or formed therein, as illustrated in FIG. 3. Furthermore, a weight stopper 70, such as a rubber stopper, may be fixed at a bottom of the guide channel 68 and configured to prevent the equalizing weights 30 from falling beyond a particular point. For example, if the cable 28 snaps or the equalizing weights 30 become disconnected from the cable 28, the weight stopper 70 may prevent the equalizing weights 30 from falling into the reservoir 34.

The container 32 may be any container or bucket configured to hold the liquid 36, such as water, therein. For example, the container 32 may include approximately 2-inch thick metal sheets arranged to be approximately 2 ft. deep, 2 ft. wide, and 3 ft. long in one embodiment of the invention. However the container may have any dimensions without departing from the scope of the invention. The container may comprise one or more safety hooks and a steel v-shaped bar attached by welding to provide structural strength to the container and/or to secure the container to the equalizing weights and/or the cable. The container 32 may be fixed to the cable 28 and/or the equalizing weights 30, preferably to one side thereof.

The container 32 may have at least one inlet hole 72 and at least one outlet hole 74 formed therein. The inlet hole 72 may be located at or proximate to a top of the container 32 and configured such that the liquid 36 may be poured into the container 32 therethrough. The outlet hole 74 or holes may preferably be formed through a bottom wall of the container 32, for releasing the liquid 36 therefrom. The container 32 may also comprise one or more flappers 76 aligned with the outlet holes 74 and configured to prevent the liquid 36 from flowing therethrough in a first, closed position and to allow the liquid 36 to flow through the outlet holes 74 in a second, open position. For example, the flappers 76 may be flexible rubber stoppers similar to those used in toilet tanks.

The flappers 76 may be attached to flexible lines 78, such as heavy carpenters strong string line or other suitably-flexible, elongated ropes, wires, cables, or cords. The flexible lines 78 may be secured above the container 32 to a frame 80 fixed relative to the ground 22 and/or the safety cover 66 placed over the top opening of the well 62. For example, the frame 80 may be a tripod made of three sucker rods or the like. The flexible lines 78 may be tied or otherwise secured to the frame 80 and may each extend to one of the flappers 76 and be secured thereto. The length of the flexible lines 78 may be determined by the length of the reciprocating element 14, the depth of the well 62, and/or the distance between the frame 80 and the reservoir 34. When the container 32 is pulled or weighed down a distance beyond the length of the flexible line 78, the flexible line 78 may naturally pull upward on the flappers 76, actuating the flappers 76 to the open position and thereby releasing any of the liquid 36 in the container 32 through the outlet hole(s) 74 thereof. In some embodiments of the invention, the flexible lines 78 may comprise an elastic section 82 made of an elastic material, such as inner tube rubber, so that when the container 32 is pulled downward by a sufficient amount, the flexing or elastic spring-back movement of the elastic section 82 lightly jerks the flappers 76 open.

The reservoir 34 may be any tank or container configured to hold the liquid 36, such as water. The reservoir 34 may have a total volume greater than the container 32 can hold and may have an open top positioned below the container 32, so that the liquid 36 released from the outlet holes 74 in the container 32 may land in the reservoir 34. In some embodiments of the invention, gravel and/or sand or other suitable particulate 84 may fill the bottom of the well 62 and the reservoir 34 may be positioned thereon. The particulate 84 may provide a level surface for the reservoir 34 absent any items that could potentially puncture the reservoir 34 or otherwise cause leakage therefrom.

The pump 38 may include one or a plurality of pumps, such as sump pumps or other pumps suitable for pumping water and the like. The pump 38 may be battery operated or may be plugged directly into an electrical power source. For example, the pump 38 may comprise three ½ horsepower sump pumps configured to pump approximately 40 gallons of water per minute. The pump 38 may be configured to run continuously and/or to be programmed to run during certain times of the day, week, month, or year.

The pump 38 may be fluidly coupled with the hoses 40 configured to transport the liquid 36 from the pump 38 to the container 32. The hoses 40, as described herein, may comprise one or more soft hoses, plumbing pipes, tubes, or any fluid-delivery means known in the art. Specifically, each of the hoses 40 may comprise an inlet and an outlet. The inlet may be aligned with an output of the pump 38 or pumps at one end and may extend upward and be fluidly coupled with the inlet hole 72 of the container 32. In some embodiments of the invention, the hoses 40 may be soft hoses attached to the container 32, such that the outlets of the hoses 40 move up and down toward and away from the reservoir 34 along with the equalizing weights 30 and the container 32.

Figure 4:
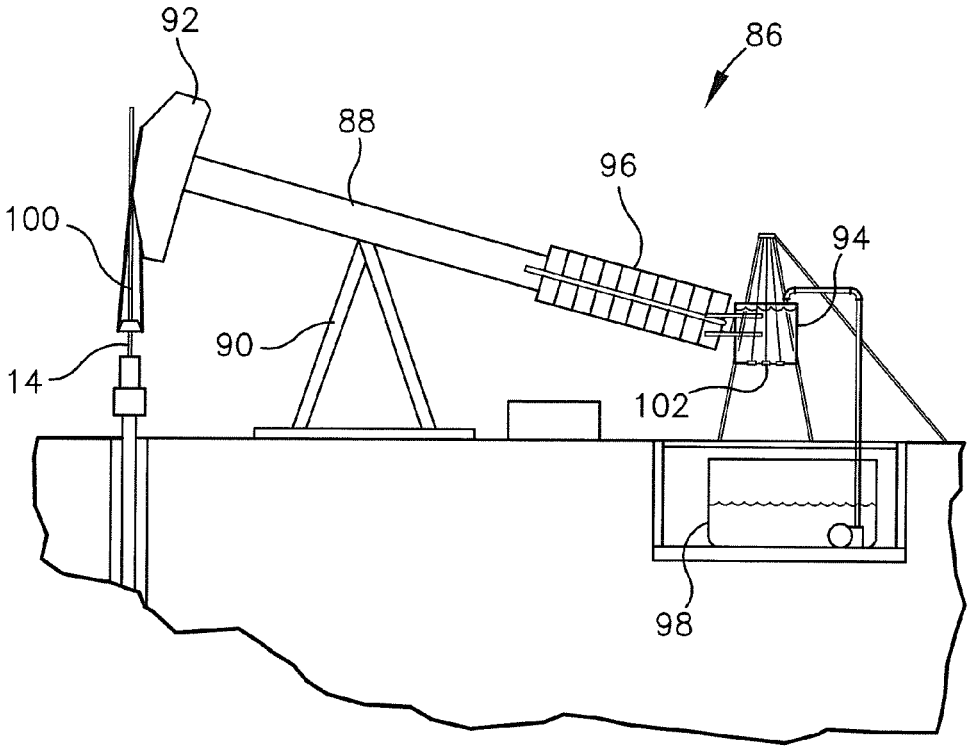
FIG. 4 is a schematic plan view of a pump actuation system constructed in accordance with an alternative embodiment of the present invention.

In some alternative embodiments of the invention, particularly for powering fluid pumping devices in low volume wells, the wheel 24 may be replaced with a teeter-totter apparatus 86, as illustrated in FIG. 4. In this alternative embodiment of the invention, the teeter-totter apparatus 86 may comprise a beam 88 configured to pivot up and down relative to a teeter-totter frame 90, with an alternative horses head fixture 92 fixed to a first end of the beam 88 and an alternative container 94 and alternative equalizing weights 96 attached to a second end of the beam 88 located opposite of the first end of the beam. As in the earlier-described embodiments of the invention, the liquid may be pumped from an alternative reservoir 98 to the alternative container 94 to pull the alternative container 94 and therefore the second end of the beam 88 in a downward direction.

As the second end of the beam 88 is pulled downward by weight of the liquid being pumped into the alternative container 94, the first end of the beam 88 is pivoted upward. This may allow alternative reigns 100 attached to the alternative horses head fixture 92 to pull the reciprocating element 14 in an upward direction. Then, when the alternative container 94 is pulled down by a certain amount, the liquid therein may be released by opening alternative flappers 102, which operate in the same manner as the flappers 76 described above. This allows the weight of the reciprocating element 14 to pull the first end of the beam 88 down as the second end of the beam 88 pivots upward. Note that the alternative horses head fixture 92, alternative reigns 100, alternative container 94, alternative equalizing weights 96, and alternative reservoir 98 are substantially identical to their corresponding components described above. Furthermore, note that in this alternative embodiment of the invention, the alternative reservoir 98 may not be located in a well. Rather, the height of the teeter-totter frame 90 and/or the length of the beam 88 may determine how high the reciprocating element 14 may be raised.

Figure 5:
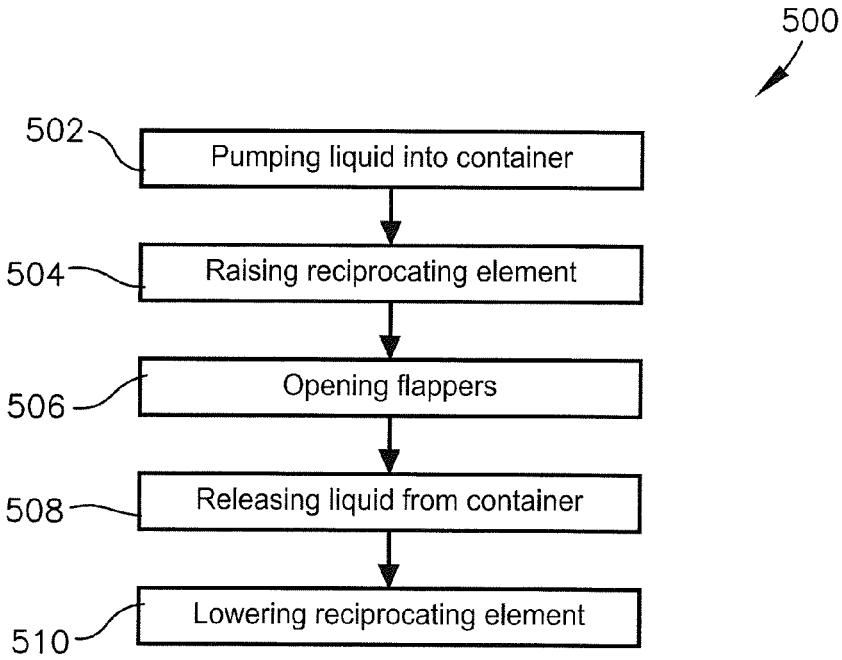
FIG. 5 is a block diagram of a method of actuating a reciprocating element of a pump in accordance with embodiments of the present invention.

The flow chart of FIG. 5 shows the functionality and operation of an exemplary implementation of the present invention in more detail. In some alternative implementations, the functions noted in the various blocks may occur out of the order depicted in FIG. 5. For example, two blocks shown in succession in FIG. 5 may in fact be executed substantially concurrently, or the blocks may sometimes be executed in the reverse order depending upon the functionality involved.

In one embodiment of the invention, FIG. 5 shows a method 500 for actuating reciprocation of the reciprocating element 14. The method 500 may comprise the steps of pumping the liquid 36 into the container 32, as depicted in block 502, and raising the reciprocating element 14, as depicted in block 504, in response to the container 32 filling with the liquid 36. Specifically, the liquid 36 being pumped from the reservoir 34 via the pump(s) 38 and hoses 40 may fill the container 32 while the flappers 76 are in the closed position. The added fluid weight may pull on the cable 28, thereby rotating the wheel 24 in a first direction and lowering the container 32 in a direction toward the reservoir 34. This rotation of the wheel 24 may cause the horse head fixture 56 to rotate, pulling on the reigns 58 and thereby raising the reciprocating element 14.

The method 500 may also comprise the steps of opening the flappers 76 when the container 32 is lowered to a predetermined point, as depicted in block 506, releasing the liquid 36 in the container 32 through the outlet holes 74, as depicted in block 508, and lowering the reciprocating element 14, as depicted in block 510. Specifically, once the lowering of the container 32 extends the flexible line 78 its full length, the continued downward pulling of the container 32 causes the flappers 76 to be pulled away from the outlet holes 74, thereby allowing the liquid 36 to be released through the outlet holes 74 into the reservoir 34 to be reused and pumped back into the container 32. Once the liquid 36 is released from the container 32, the weight of the reciprocating element 14 is greater than the weight of the equalizing weights 30 and the container 32. So without the weight of the liquid 36 in the container 32, gravity allows the reciprocating element 14 to be lowered. The lowering of the reciprocating element 14 pulls on the reigns 58 and therefore the horse head fixture 56. This motion rotates the wheel 24 in a second direction, pulling on the cable 28 and therefore raising the container 14 away from the reservoir 34.

In some configurations of the invention, the pump(s) 38 may be operated substantially continuously. Therefore, the method 400 may be repeated once the container 32 is again filled enough that the weight of the liquid 36 therein combined with the weight of the container 32 and the equalizing weights 30 is sufficient to overcome the weight of the reciprocating element 14. In some embodiments of the invention, the flow rate of liquid being pumped into the container 32 may be less than the flow rate of liquid flowing out of the container 32 once the flappers 76 are opened or released, such that the container 32 and equalizing weights 30 may rise by a certain amount before the container 32 is filled again. In an alternative embodiment of the invention, the pumps 38 may be programmed to shut off when the flappers 76 open and to turn back on again when the flappers 76 close.

The weight of the pump actuating system 10 may be significantly less than the weight of conventional pump actuating systems, because traditional tail bearings and saddle bearings are eliminated from this design. For example, the pump actuating system 10 may be less than 25,000 lbs, while conventional pump actuating systems may weigh approximately 160,000 lbs. Even in the alternative embodiment of the invention illustrated in FIG. 4, a conventional motor belt and weights attached at the gear box may be removed, thereby reducing the total weight of the system. This reduction in weight makes the pump actuating system 10 easier to transport to new locations, as needed.

Although embodiments of the invention have been described with reference to the embodiments illustrated in the attached drawing figures, it is noted that equivalents may be employed and substitutions made herein without departing from the scope of the invention as recited in the claims. For example, the wheel 24 and the beam 88 described herein may each be generally referred to in the claims as a primary actuation element, and the horse head fixture 56 and reigns 58 described above may generally be referred to in the claims as an attachment element. Furthermore, the use of the pump actuation system 10 for an oil well is merely exemplary. The pump actuation system 10 could be used to power any reciprocating element in any pumping system. For example, the pump actuation system 10 could be used to power turbines of windmills when wind speeds are low, to power water wells, and to power heating and cooling exchange systems for home or industrial use without departing from the scope of the invention.

Having thus described various embodiments of the invention, what is claimed as new and desired to be protected by Letters Patent includes the following:

1. An actuation system for pumping fluids out from under ground, the actuation system comprising:

a pump jack comprising a sucker rod configured to reciprocate into and out of an oil well drilled into the ground;

a base;

a wheel rotatably attached to the base;

a horse head fixture fixed to the wheel;

one or more reigns attached to the horse head fixture and attached to the sucker rod, such that rotation of the wheel in a first direction raises the sucker rod and rotation of the wheel in a second direction lowers the sucker rod;

a cable attached to the wheel and configured to be wound on and unwound from the wheel as the wheel rotates;

a container attached to the cable, such that rotation of the wheel in the first direction lowers the container and rotation of the wheel in the second direction raises the container, wherein the container comprises at least one outlet hole formed therethrough and one inlet hole formed therethrough;

equalizing weights fixed to the cable and weighing less than a weight of the reciprocating element;

a flapper configured for covering the outlet hole in a first position and uncovering the outlet hole in the second position such that liquid may exit through the outlet hole;

a frame fixed relative to the ground and above the container;

a flexible line having a first end and a second end, the first end being attached to the frame and the second end being attached to the flapper and limiting an amount by which the flapper can be lowered relative to the frame, such that when the container is lowered past a predetermined point, the container pulls away from the flapper, placing the flapper in the second position;

a reservoir configured to hold liquid and located beneath the container outlet hole;

at least one pump located in the reservoir and configured to pump liquid out of the reservoir; and a hose fluidly connecting the pump with the inlet hole of the container.

2. The actuation system of claim 1, further comprising alignment fixtures configured to keep the reigns in a desired alignment with the wheel.

3. The actuation system of claim 1, wherein the reservoir is located below ground level in a well.

4. The actuation system of claim 1, wherein the flexible line comprises at least a portion made of elastic material.

5. The actuation system of claim 1, further comprising one or more motion-limiting components preventing at least one of the wheel from rotating beyond a desired rotation amount and the equalizing weights from being lowered beyond a desired lowering amount.

* * * * *